United States Patent [19]

Borgheresi

[11] Patent Number: 4,754,684

[45] Date of Patent: Jul. 5, 1988

[54] SHOTGUN SHELL SHORTENER AND METHOD

[76] Inventor: Enrique Borgheresi, P.O. Box 8063, Greenville, S.C. 29604

[21] Appl. No.: 36,927

[22] Filed: Apr. 10, 1987

[51] Int. Cl.[4] ..... F42B 33/00; F42B 35/02; F42B 5/30

[52] U.S. Cl. ..... 86/24; 29/1.32; 30/90.1; 30/103; 86/1.1; 86/10; 86/39; 86/40; 86/49; 102/466; 102/467

[58] Field of Search ..... 86/12, 11, 19, 49, 22, 86/1.1, 23, 10, 24, 25, 28, 39, 40, 41, 42; 42/90; 29/1.31, 1.32, 1.3; 30/90.1, 103; 82/82, 70.2; 102/465, 466, 467

[56] References Cited

U.S. PATENT DOCUMENTS

| | | | |
|---|---|---|---|
| 2,868,058 | 1/1959 | Dom | 86/24 |
| 2,869,413 | 1/1959 | Anderson | 86/24 |
| 3,347,128 | 10/1967 | Bachhuber | 86/39 |
| 3,908,253 | 9/1975 | Bolen | 29/1.32 |
| 4,065,541 | 12/1977 | Eckstein et al. | 264/332 |
| 4,325,282 | 4/1982 | Schaenzer | 86/24 |
| 4,441,400 | 4/1984 | Sexton | 86/1.1 |
| 4,686,751 | 8/1987 | Gracey | 29/1.32 |

*Primary Examiner*—Stephen J. Lechert, Jr.
*Assistant Examiner*—Howard J. Locker
*Attorney, Agent, or Firm*—Cort Flint

[57] ABSTRACT

A method and device (A) for cutting a shotgun shell (14) for shooting in a shotgun chambered for shorter shotgun shells includes a base (10) and shell receiving tube (12). A shell (14) is held in tube (12) above a knife (32) in such a manner that a circumferential slit is formed in shell casing (20) around the inside edge (24) of crimp (22). The knife is carried on a movable knife blade holder (40) which moves toward base (10) to engage the knife in the crimped edge as the shell is rotated. Upon shooting of shell (14), the crimp material separates from casing (20) leaving the shell of a shorter length. In this manner a two and one half inch ($2\frac{1}{2}''$) shell is obtained from a two and three-quarter inch ($2\frac{3}{4}''$) and three inch (3") shells which may be reloaded or disposed of.

26 Claims, 2 Drawing Sheets

Fig. 3.
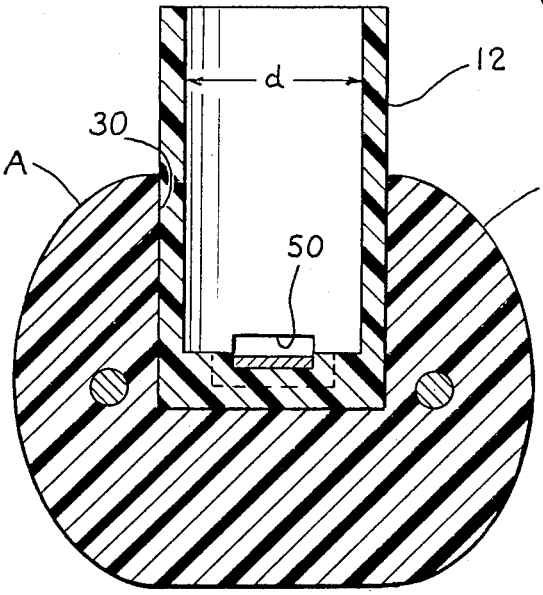
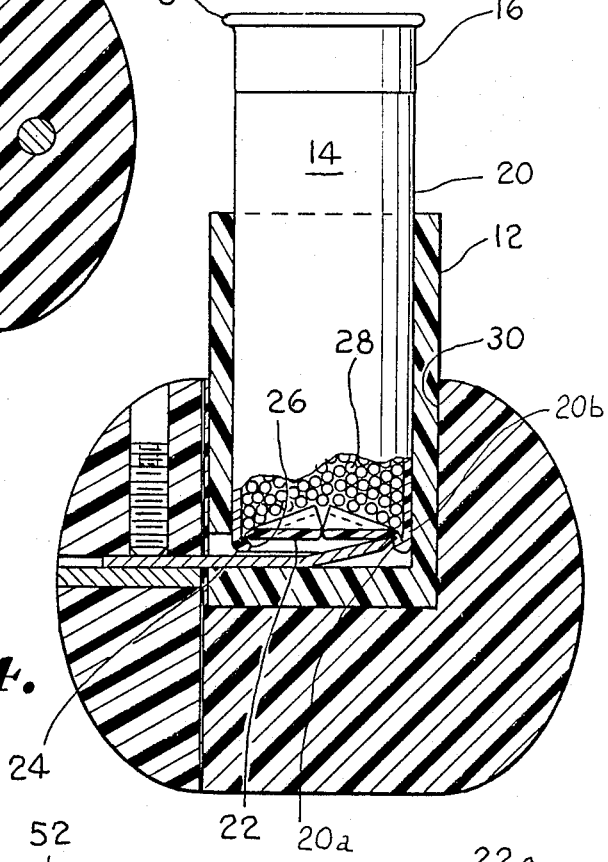
Fig. 4.
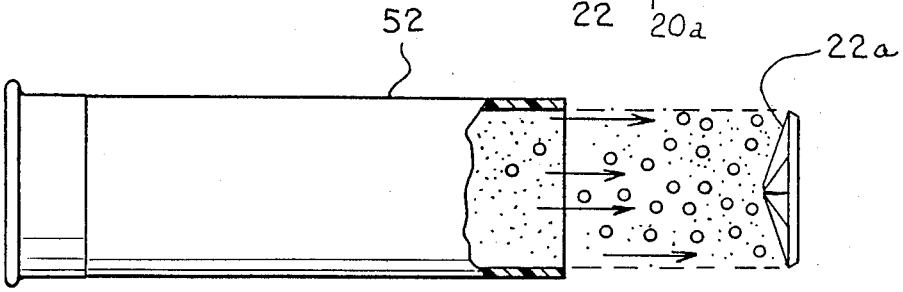
Fig. 5.

SHOTGUN SHELL SHORTENER AND METHOD

BACKGROUND OF THE INVENTION

The invention relates to a device and method for shortening a loaded, star-crimped shotgun shell while still loaded and prior to firing it.

Shotgun shell lengths are customarily specified as the length after firing. All present day shotguns are designed for use with two and three-quarter inch (2¾") or three inch (3") shells, due to the fact that the shotgun shell manufactures decided to adopt these lengths as standard after World War II. Thus, the shorter, standard shotgun shell, two and nine-sixteenth inch (2 9/16"), of yesteryears has become almost nonexistent. However, there are still many shotguns in use which are chambered for the shorter two and nine-sixteenth inch (2 9/16") shells.

When loaded, both the two and three-quarter (2¾") and the two and nine-sixteenth (2 9/16") shells are just about the same length, two and three-eighth inch (2⅜"), and this has led sportsmen to make the mistake of firing the longer shells in guns with shorter chambers. Usually, this does not represent a danger for the shooter, but the life of the shotgun is diminished due to the higher chamber pressures produced by the powder while trying to push the load through a less than standard diameter. This reduced shell diameter is caused by the extra length at the end of the shell distending onto the cone of force, which is located between the chamber and the bore of the barrel.

Accordingly, an object of the invention is to provide a simple, easily operable device for shortening a loaded shotshell to suit a chamber shorter than that suited for the length of the fired shell. Thus, the device produces a cut inside the edge of the crimp of loaded shotgun shells, turning the portion of the cartridge, usually called star-crimp, into the equivalent of the cardboard wad that was used in the old two and nine-sixteenth inch (2 9/16") shells for containing the lead shot. On firing a cut shotshell, the portion called star-crimp leaves the shotgun ahead of the lead shot, just as the old cardboard wad used to do. The shell is automatically shortened upon firing and excessive chamber pressures are avoided.

Another object of the invention is to provide a device that can be adjusted to cut loaded shotgun shells of different gauges in the same, simple manner.

Still another object of the present invention is to trim off the jagged front edge of already fired, star-crimped shotshells intended for reloading.

SUMMARY OF THE INVENTION

The above objects are accomplished according to the invention by providing a shotgun shell shortening device which includes a base and a tube carried on the base having an inside diameter corresponding to the diameter of the shotgun shell. The tube receives the shotgun shell for rotation. A moveable knife protrudes into a lower portion of the tube for engaging an inside edge of the star-crimp of the shotgun shell to form a cut-thru in the edge of crimp when the shell is rotated. Thereafter, the shell may be loaded in a shotgun and fired. Upon the shooting of the shell, two and three-quarter inch (2¾"), the star-crimp material separates from the shell casing at the cut. With the separation of the crimp material, the shell is a length equal or slightly shorter that the chamber of the shotgun chambered for two and nine-sixteenth inch (2 9/16") shells. In the case of the two and three-quarter inch (2¾") shell, this device shortens the shell so that after it is shot it is in the proper length for reloading as a two and one-half inch (2½") shell. In this manner, an entire box or boxes of shells may be rotated in the device to form a pre-firing cut. The shells may then be carried to the field for firing. Upon ejection from the shotgun, the shells are of a length to be reloaded as a two and one-half inch (2½") shell. The disadvantages of trimming a spent shell casing are eliminated in accordance with the present invention.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a sectional view taken along line 3—3 of FIG. 1;

FIG. 4 is a sectional view, the same as taken in FIG. 2, illustrating a shotgun shell being received in the shortening device and the knife of the device in engagement with the shotgun shell for forming a cut in the loaded shell before shooting; and FIG. 5 is a side elevation illustrating a shotgun shell being shot with the result that the star-crimp material separates at the cut formed by the device of the present invention.

DESCRIPTION OF A PREFERRED EMBODIMENT

Figure 1:
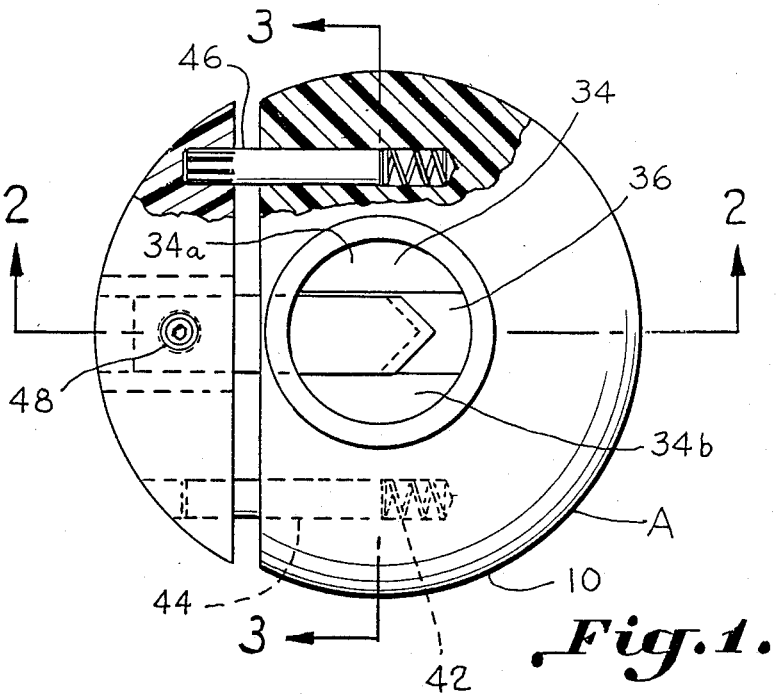
FIG. 1 is a top plan view with parts cut away of a shotgun shell shortening device constructed in accordance with the present invention.

Referring now in more detail to the drawings, a shotgun shell trimming device A is illustrated which includes a base in the form of a ball element 10 which may be made of any suitable material such as wood or plastic. A shotgun shell tube 12 is carried by base 10 in a removable fashion. Shotgun shell tube 12 has an inside diameter "d" which would correspond to the outside diameter of a shotgun shell 14. A typical shotgun shell 14 includes a head 16 having a rim 18 affixed to one end of a shotgun shell casing 20. The opposing end of casing 20 includes a crimped end, generally designated as 23, which includes a star-crimp 22 surrounded by a crimp edge 24. Edge 24 has an inside circumference 26 surrounding crimp 22. The shell is loaded with shot 28.

In accordance with the present invention, shell tubes 12 are held in a circular bore 30 formed in base 10. Tubes 12 may be made of different diameters "d" to hold different gauge shotgun shells. The outside diameter of tube 12 will remain constant so that each tube can be received in circular bore 30 while a different inside diameter will accommodate different gauge shells. In this manner, the device may be made applicable to shortening or trimming any shotgun shell gauge.

Figure 2:
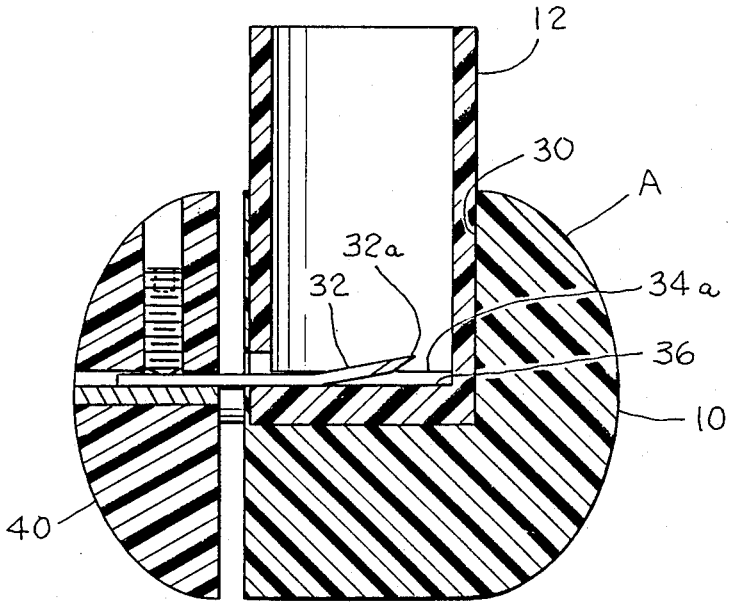
FIG. 2 is a sectional view taken along line 2—2 of FIG. 1.

A knife 32 extends into the interior of shell tube 12, as can best be seen in FIGS. 1 and 2. Carrier means for carrying a shotgun shell in a manner that crimped end 23 of the shell extends over knife 32 so that an end 32*a* of the knife extends into the inside circumference 26 of crimp edge 24 is provided. This carrier means includes ledge means 34 and groove means 36. Groove means 36 includes a groove 36*a* formed in the bottom of tube 12 between two raised ledges 34*a* and 34*b* of edge means 34. This allows the knife to slide under the crimped end of shotgun shell 14. The crimp edge 24 rides on the ledges 34*a* and 34*b* as shell 14 is rotated in tube 12 to form a cut circumferentially in edge 26 of star-crimp 22.

Engagement means for engaging knife 32 into the inside edge 26 is provided by a movable knife holder 40 in the shape of the ball-like base 10. Thus, base 10 and movable knife holder 40 may be held in the palm of the hand in a comfortable manner. As can best be seen in FIGS. 2 and 4, movable knife holder 40 may be squeezed towards base 10 so that knife 32 penetrates the inner casing 20*a* of shell 14. Biasing means 42 urges a pair of spaced guides 44 outwardly. As knife holder 40 is squeezed inwardly and released, it returns to the position shown in FIGS. 1 and 2. Squeezing of knife holder 40 towards base 10, as can best be seen in FIG. 4, moves knife 32 into engagement with inner wall casing 20*a* of shell 14 to form a circumferential cut in crimp edge 26 as shell 14 is rotated relative to the tube 12. Preferably, this cut is complete through the inner wall casing 20*a*. Star-crimp 22 is then loose within the shell like the cardboard wad in the older type shells. The star-crimp material leaves the shell upon firing in the shotgun and a shortened shell is left as can best be seen in FIG. 5.

Knife 32 is held and affixed in knife holder 40 by means of a set screw 48. End 32*a* of knife 32 is bent upwardly, as can best be seen in FIG. 4, from the base of groove 36*a* to the inside edge 26 of crimp 22. For this purpose, a slot 50 is formed in the side of cylinder 12 to allow for the passage of knife 32 therethrough. Alternately, the bottom of tube 12 may be left open and the ledges 34*a* and 34*b*, and groove 36 formed in base 10.

To set knife 32 properly, a fired shell without star-crimp 22 and inner casing 20*a* is placed into tube 12, i.e. a straight, open end. Knife 32 is adjusted so that movement of holder 40 brings the knife into contact with outer wall casing 20*b*. When a new shell is placed into tube 12, knife 32 will penetrate inner casing 20*a* and a complete cut through casing 20*a* will occur when the shell is rotated. The complete cut is thought to be necessary due to the tensile strength of the plastic casing material which otherwise might not allow separation and shortening upon firing. The cut edge of inner casing 20*a* retains star-crimp 22 until firing.

Referring now to FIG. 5, it can be seen that with the cut formed in the inside edge of crimped edge 24, the star-crimped material 22*a* of crimp 22 will separate from shell casing 20 upon being shot in a shotgun. Since, in the case of a two and three-quarter inch (2¾") shell, crimp material 22*a* will be approximately one-quarter inch (¼") long, the remaining shell carcas 52 will be a two and one-half inch (2½") shell. The two and one half-inch (2½") shell may be reloaded with a conventional cardboard wad. In this manner, it can be seen that circumferential cuts may be formed in a box or boxes of shells by utilizing the device and method of the present invention. After being shot in a shotgun, the spent casing 52 may be picked up and reloaded to provide two and one-half inch (2½") shells automatically without further trimming or modification of the shell.

The device is also useful and valuable as a trimmer. In the case of firing two and three-quarter inch (2¾") shells which have not been shortened, the star-crimp material 22 is left on the end of the shell as one piece. The outer most edge of the fired shell may be jagged. Before reloading a two and three-quarter inch (2¾") shell, the jagged edge needs to be trimmed. According to the invention, this is simple. The fired shell is placed in tube 12 and rotated with knife 32 pushed in. The jagged edge will automatically be trimmed off.

While a preferred embodiment of the invention has been described using specific terms, such description is for illustrative purposes only, and it is to be understood that changes and variations may be made without departing from the spirit or scope of the following claims.

What is claimed is:

1. A device for cutting a loaded shotgun shell so that the shell may be shortened, said shotgun shell being of the type having a casing with a crimped end with a star-crimp formed therein, said device comprising:

a base;

a knife carried by said base;

carrier means for carrying a shotgun shell on said base in a manner that said crimped end of said shell extends over said knife in a position that said knife may engage an inside circumference of said crimped edge adjacent said star-crimp; and engagement means for engaging said knife in said crimped edge to form a circumferential cut in said shell casing so that said star-crimp separates from said shell and said shell is shortened upon firing.

2. The device of claim 1 wherein said carrier means includes a tube carried by said base having an inside diameter generally equal to the diameter of said shell casing in which said shotgun shell may be received and rotated relative to said knife.

3. The device of claim 2 wherein said carrier means includes ledge means which may be engaged by said crimped end of said shotgun shell to support said shotgun shell above said knife.

4. The device of claim 3 including groove means carried below said ledge means in which said knife is carried at a distance below said ledge means.

5. The device of claim 4 wherein said knife includes a bent end which is inclined upwardly from said groove means slightly above the level of said ledge means to engage said inside circumference of said crimped edge.

6. The device of claim 1 wherein said carrier means includes ledge means carried by said base which may abut and support said crimped end of said shell to position said shell for engagement with said knife.

7. The device of claim 3 wherein said ledge means is formed in said tube and a knife slot is formed in a side wall of said tube which permits said knife to enter said tube between said ledge means.

8. The device of claim 1 wherein said engagement means comprises a movable knife holder carried by said base to which said knife is affixed, and said knife holder being carried by said base in a manner that permits movement of said knife in and out of engagment with said inside circumference of said crimped edge of said shotgun shell.

9. The device of claim 1 wherein said engagement means comprises a movable knife holder carried by said base to which said knife is affixed, said movable knife holder being movable only a prescribed distance so that a cut is formed of a prescribed depth in said crimped edge which allows for a complete cut through the thickness of an inner wall of said shotgun shell casing at said crimped end.

10. A device for trimming a shotgun shell of the type having a casing with a star-crimped end comprising:

a base;

a shell tube carried by said base having a curved interior surface for rotatably receiving said shotgun shell; a knife carried by said base adjacent a lower portion of said tube arranged for relative, rotational movement with said shotgun shell; and said knife being adapted for engagement with said shell received in said shell tube in such a manner that said knife forms a circumferential cut around an inside circumference of said crimped edge as said shell and knife are rotated relative to each other.

11. The device of claim 10 including ledge means which said shotgun shell abuts when placed in said shell tube for supporting said crimped end of said shell above said knife in a manner that said knife engages said inside edge of said crimp.

12. The device of claim 11 including groove means formed below said ledge means in which said knife is carried.

13. The device of claim 10 including opening means formed in said tube through which said knife protrudes to engage said edge of said shotgun shell.

14. The device of claim 13 wherein said opening means includes a slot formed in a side wall of said tube through which said knife protrudes.

15. The device of claim 10 including a movable knife holder for carrying said knife into and out of engagement with said edge of said crimp.

16. The device of claim 15 wherein said knife holder is reciprocally carried by said base for reciprocal movement in and out of engagement with said edge of said crimp.

17. The device of claim 15 wherein said knife holder is biased away from said base.

18. The device of claim 15 including a pair of spaced guides which carry said knife holder on said base, and said knife is affixed to said knife holder intermediate said guides.

19. A method of shortening a star-crimped shotgun shell in a shotgun comprising:

forming a circumferential cut of a depth generally equal to the thickness of the casing of said shell around an inside edge of star-crimp in a manner that said star-crimp is separated from said shell casing and said shell is shortened upon firing.

20. A method of trimming shotgun shells to provide a shell with shorter length including:

forming a circumferential cut in a casing of said shell;

forming said circumferential cut around the inside circumference of said casing from the inside outward through said shell casing;

rotatably supporting said shell relative to a knife in a manner that rotation of said said shell and knife relative to each other forms said circumferential cut; and separating a portion of said shell casing from said shell at said circumferential cut.

21. The method of claim 20 including forming said circumferential cut in an inside circumference of an edge of a crimp which closes said shell casing.

22. The method of claim 21 including rotating said shell in a tube above said knife which engages said inside circumference of said edge of said crimp.

23. A device for trimming and shortening a shotgun shell having a star-crimp end comprising:

carrier means for supporting said shell; and knife means for forming a uniform cut in an inner circumference of said casing around said star-crimp while said shell is supported by said carrier means in the manner that said star-crimp may be separated from said shell to shorten said shell.

24. The device of claim 23 including holder means for said knife means limiting the depth of said cut.

25. The device of claim 23 including holder means for moving said knife means into and out of said casing and for limiting the distance of penetration into said casing.

26. The device of claim 23 wherein said carrier means supports said shell to permit relative rotation between said knife means and shotgun shell.

* * * * *